US006874268B2

(12) United States Patent
Baumann et al.

(10) Patent No.: US 6,874,268 B2
(45) Date of Patent: Apr. 5, 2005

(54) GUN

(75) Inventors: Berthold Baumann, Eschede (DE); Eckehard Bohnsack, Unterlüss (DE); Friedhelm Knörich, Düsseldorf (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 10/698,628

(22) Filed: Nov. 3, 2003

(65) Prior Publication Data

US 2004/0200346 A1 Oct. 14, 2004

(30) Foreign Application Priority Data

Nov. 12, 2002 (DE) ..... 102 52 416

(51) Int. Cl.[7] ..... F41A 23/52; F41A 25/00
(52) U.S. Cl. ..... 42/75.02; 89/37.13
(58) Field of Search ..... 42/75.01, 75.02; 89/37.13

(56) References Cited

U.S. PATENT DOCUMENTS

| | | | | |
|---|---|---|---|---|
| 2,014,184 A | * | 9/1935 | Linder | 42/75.02 |
| 2,110,165 A | * | 3/1938 | Moore | 42/75.02 |
| 4,483,235 A | | 11/1984 | Hallqvist | |

FOREIGN PATENT DOCUMENTS

| | | | | |
|---|---|---|---|---|
| CS | 77659 | * | 6/1949 | 42/75.02 |
| DE | 31 48 265 A1 | | 6/1983 | |
| GB | 2 157 406 A | | 10/1985 | |
| IT | 373 517 | * | 11/1939 | 42/75.02 |

* cited by examiner

*Primary Examiner*—Stephen M. Johnson
(74) *Attorney, Agent, or Firm*—Venable LLP; Stuart I. Smith

(57) ABSTRACT

A gun in which the gun barrel (2) is seated to be axially displaced in a cradle barrel. To avoid a lifting effect of the gun barrel (2) upon firing, and omit the necessity of complicated guide grooves in the cradle barrel (3) and tabs on the gun barrel (2), an elastically deformable, first slide-bushing bearing (5) is provided at the muzzle end of the cradle barrel, and a second slide-bushing bearing (6) with a predetermined amount of fit play is provided at the breech-ring end of the cradle barrel 3. The barrel bushing (7) of the first slide-bushing bearing (5) has segment-like, outside recesses (16) between adjacent support ribs (14) on its outer surface, and segment-like, inside recesses (19) on its inner wall (17) opposite the support ribs (14), so that when the gun barrel (2) expands, the barrel bushing (7) deforms elastically such that regions of the barrel bushing (7) resting against the gun barrel (2) are arched outward into the outside recesses (16), and the regions of the barrel (2) that do not rest against the inner wall (17) can move into the inner recesses (19) of the barrel bushing (7).

6 Claims, 2 Drawing Sheets

GUN

CROSS REFERENCE TO RELATED APPLICATION

This application claims the priority of German Patent Application, DE 102 52 416.5 filed Nov. 12, 2002 and which is incorporated herein by reference.

BACKGROUND OF THE INVENTION

The invention relates to a gun in which the gun barrel is seated to be displaced in a cradle barrel.

A gun of this type is known from, for example, German Laid open Patent Application DE 31 48 265 A1. Here, the barrel is seated in two slide-bushing bearings that are disposed at the muzzle and breech ends of the cradle barrel. A drawback of this known slide-bushing mounting is that the gun barrel, for example of a tank gun, must rest on the lower inside edge of the bearing because of its mass, and rises because of the barrel expansion that occurs upon firing. This causes the barrel to vibrate, and adversely affects the jump error of the respective projectile.

It is known from German Laid open Patent Application DE 39 36 454 A1 to avoid the barrel vibrations that occur upon firing by using bearings that are free of the lift effect, instead of conventional slide-bushing bearings. With bearings free of the lift effect, the gun barrel does not impact a fixed stop in the radial direction upon firing, so the barrel can expand horizontally as well as vertically. Four guide rails, which are uniformly distributed around the circumference of the barrel and extend in the direction of the longitudinal axis, serve in mounting the gun barrel in the cradle. The guide rails are formed as slide rails, and extend into corresponding guide grooves of the cradle barrel such that the directions of the bearing force and the radial barrel expansion are perpendicular to one another.

The biggest drawback of this mounting arrangement is that the guide rails and guide grooves extend past both bearing points, which is complex from a manufacturing engineering standpoint. Furthermore, changing the barrel in such guns is complicated and therefore time-consuming.

Finally, German Patent Application No. 102 26 534.8, corresponding to U.S. patent application Ser. No. 10/414, 242, filed Apr. 16, 2003, discloses a gun in which the lifting effect of the barrel is extensively avoided through the provision of a slide-bushing bearing, at least on the muzzle side of the gun barrel, but preferably also at the rear of the barrel. The slide-bushing bearing comprises a barrel bush busing in which the gun barrel is seated, free from the lift effect. The outside surface of the bushing is seated in the cradle barrel so as to slide in a form-fit (i.e., with the smallest amount of play), effecting an axial and radial sliding guidance of the gun barrel that are independent of one another. Upon firing, tab-shaped projections engage corresponding groove-shaped recesses in the barrel bush, effecting the radial sliding guidance of the gun barrel by holding it centrally in the barrel bushing. A radial expansion is, again, compensated by a predetermined amount of play between the inside or inner surface of the barrel bush and the gun barrel, or an inner ring that is attached to it, fixed against relative rotation, and supports the tab-shaped projections.

One of the disadvantages of this gun barrel is the relatively complicated arrangement of the tab-shaped projections, which must be mounted either directly to the barrel or indirectly via an intermediate ring.

SUMMARY OF THE INVENTION

It is the object of the invention to provide a gun that is seated to be displaced in a cradle barrel, and in which a lifting effect of the gun barrel is extensively avoided, and neither complex guide grooves in the cradle barrel nor tabs on the barrel are necessary.

The above object generally is achieved according to the present invention by a gun, in which the gun barrel is seated to be axially displaceable in a cradle barrel of a gun cradle, with the gun barrel being seated in a first slid-bushing bearing disposed at the muzzle end of the cradle barrel, and in a second slide-bushing bearing disposed at the breech-ring end of the cradle barrel, and wherein the first slide bushing bearing is modified in a particular manner. More specifically, the present invention is essentially based on the concept of forming the first slide-bushing bearing disposed at the muzzle side of the gun barrel, as a barrel bushing that is supported in a form-fit against the inner or inside wall of the cradle barrel by at least three segment-like support ribs, which are uniformly distributed around the circumference of the bushing. Between the adjacent support ribs, the barrel bush has recesses on the outside or outer surface, and segment-like recesses on the inside, on its inner wall opposite the support ribs, so that when the gun barrel expands, the barrel bushing deforms elastically such that the regions of the barrel bushing that rest against the gun barrel arch outside into the outer recesses, and the regions of the barrel that do not rest against the inner wall of the barrel bushing can move into the inside or inner recesses of the barrel bush.

It has proven advantageous for the barrel bushing to be supported by four or more segment-like support ribs on the inner wall of the cradle barrel, the ribs being uniformly distributed around the circumference, with two support ribs being provided horizontally on the barrel bushing and two support ribs being provided vertically on the barrel bush. More support ribs can also be provided, however. Further, particularly advantageous, embodiments of the invention are disclosed.

Because the axial guidance of the gun barrel is effected by the support ribs of the barrel bush, it has proven advantageous for the support ribs to be provided with a slide-conducive coating.

Because there is no axial rail guidance, or tabs on the barrel, the manufacturing outlay is lower than for the known guns. Moreover, the proposed mounting of the barrel is very robust, and the barrel can be changed very quickly and simply in the field.

Further details about and advantages of the invention ensue from the following exemplary embodiments explained in conjunction with figures.

DETAILED DESCRIPTION OF THE INVENTION

Figure 1:
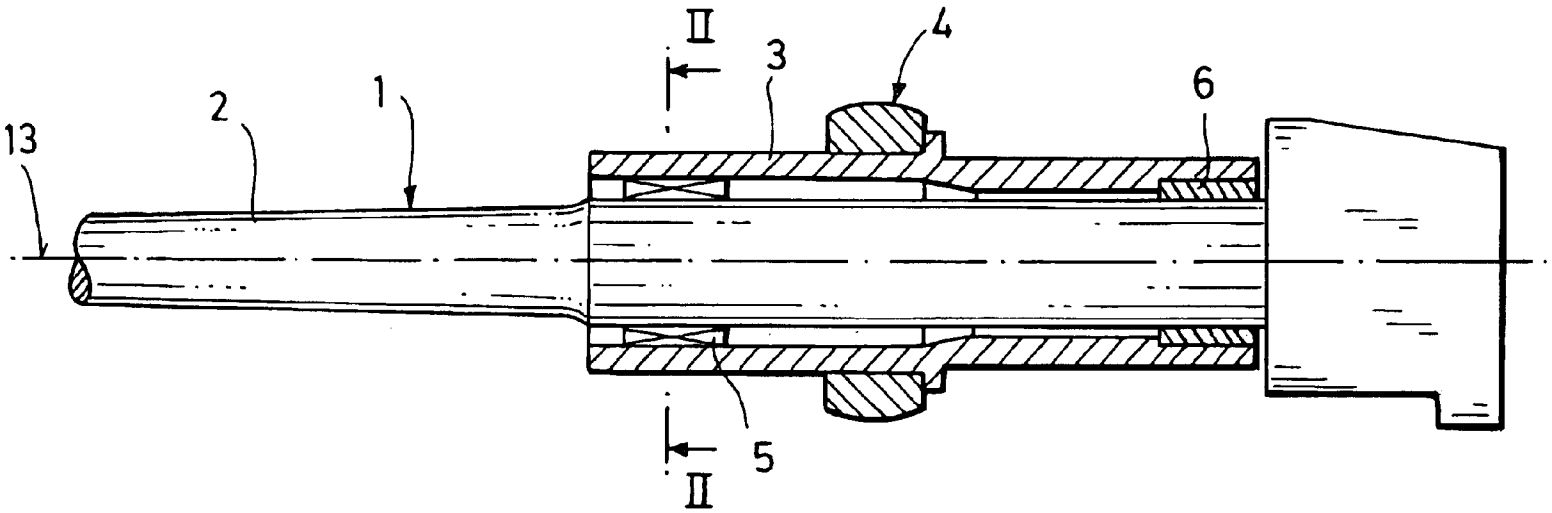
FIG. 1 is a schematic representation of a gun barrel that is mounted in a cradle barrel having a respective slide-bushing bearing at the muzzle end and one at the breech-ring end.

FIG. 1 illustrates a gun 1, in which the gun barrel 2 is seated to be axially displaced in a cradle barrel 3 of a cradle 4. For this purpose, a first slide-bushing bearing 5 is disposed at the muzzle end of the cradle barrel 3, and a second, conventional slide-bushing bearing 6 is disposed with a predetermined amount of fit play at the breech-ring end of the cradle barrel 3.

Figure 2:
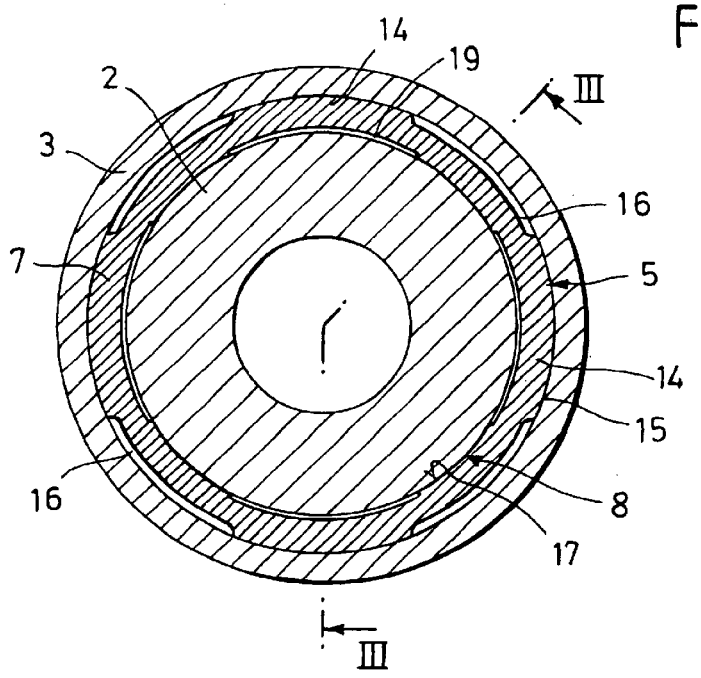
FIG. 2 is a cross-section through an exemplary embodiment of a slide-bushing bearing shown in FIG. 1, along the section line II—II.
Figure 3:
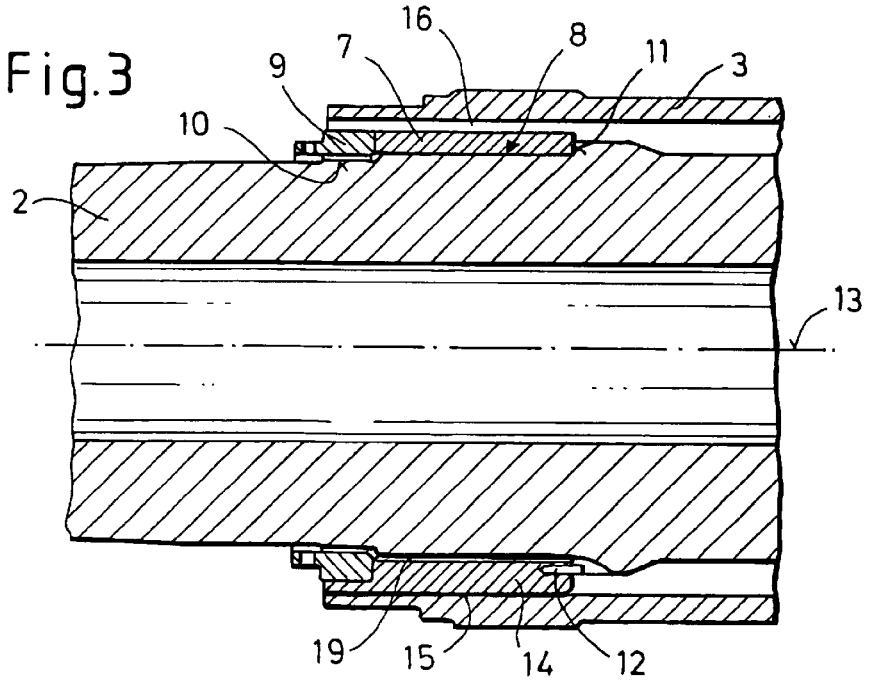
FIG. 3 is a longitudinal section through the slide-bushing bearing along the section line III—III shown in FIG. 2.

The first slide-bushing bearing 5 comprises an elastically deformable barrel bushing 7, and is seated, with diagonally positioned, segment-like bearing shells 8, without play on the gun barrel 2 (FIGS. 2 and 3). The barrel bushing 7 is screwed axially against a barrel shoulder 11 of the gun barrel 2 by means of a counter-ring 9, which is screwed to the barrel 2 by a thread 10. Two anti-rotation devices 12, for example, pins or keys, prevent the barrel bushing 7 from rotating about the barrel axis 13.

Two horizontally disposed and two vertically disposed, segment-like support ribs 14 are positioned at the outer circumference of the barrel bushing 7 for supporting the gun barrel 2 so that it can be longitudinally displaced inside the cradle barrel 3. The support ribs 14 are provided with a slide-conducive coating 15 to reduce friction. The barrel bushing 7 has segment-like, outer recesses 16 disposed between adjacent support ribs 14.

The segment-like bearing shells 8 are disposed on the inside wall 17 of the barrel bushing 7, opposite the outside recesses 16, while four segment-like, inner surface recesses 19 are disposed opposite the support ribs 14.

The function of the gun 1 of the invention, and thus the function of the slide-bushing bearing 5, are explained in detail below:

After a cartridge is ignited, the gun barrel 2 expands elastically as the corresponding projectile passes through it. The barrel bushing 7 deforms elastically such that the respective region of the barrel bushing 7 that ends at the segment-like bearing shell 8 seated without any play on the gun barrel 2 is arched outward into the outer surface recesses 16, and the remaining barrel walls that do not rest against the gun barrel can move into the inner surface recesses 19 of the barrel bushing 7. This avoids the transmission of the barrel expansion to the segment-like support ribs 14, and therefore to the cradle barrel 3. There is no lifting effect as occurs in conventional guns.

The invention now being fully described, it will be apparent to one of ordinary skill in the art that many changes and modifications can be made thereto without departing

What is claimed is:

1. A gun, including a gun barrel that is seated to be axially displaceable in a cradle barrel of a gun cradle, wherein:

the gun barrel is seated in a first slide-bushing bearing disposed at a muzzle end of the cradle barrel, and in a second slide-bushing bearing disposed at a breech-ring end of the cradle barrel;

the first slide-bushing bearing comprises a barrel bushing that is attached to an outer surface of the gun barrel and is supported in a form-fit against an inner wall of the cradle barrel by at least three segment-like support ribs distributed uniformly around the outer circumferential surface of the first slide-bushing bearing; and the barrel bushing has segment-like, outer surface recesses disposed between adjacent support ribs, and respective segment-like, inner surface recesses disposed on an inner circumferential surface wall and opposite respective support ribs, so that when the gun barrel expands, the barrel bushing deforms elastically such that the regions of the barrel bushing resting against the gun barrel are arched outwardly into the outer surface recesses, and the regions of the gun barrel that do not rest against the inner wall of the barrel bushing can move into the inner recesses of the barrel bushing.

2. The gun according to claim 1, wherein the barrel bushing is supported against the inner wall of the cradle barrel by at least four of said support ribs distributed uniformly around the circumference of the barrel bushing.

3. The gun according to claim 2, wherein there are four of said support ribs, with two of said support ribs being disposed horizontally on opposite sides of the barrel bushing, and with two of said support ribs being disposed vertically on opposite sides of the barrel bushing.

4. The gun according to claim 1, wherein the support ribs are provided with a slide-conducive coating on their outer surface facing the inner wall of the cradle barrel.

5. The gun according to one of claim 1, wherein the barrel bushing is provided with bearing shells in the regions which rest against the surface of the gun barrel.

6. The gun according to claim 1, including means for preventing rotation of the barrel bushing.

* * * * *